United States Patent [19]

Waldner

[11] Patent Number: 4,703,644

[45] Date of Patent: Nov. 3, 1987

[54] DIE APPARATUS HAVING AN ELECTROMAGNETIC DRIVE

[76] Inventor: Kurt Waldner, 12260 Saraglen Dr., Saratoga, Calif. 95170

[21] Appl. No.: 828,154

[22] Filed: Feb. 10, 1986

[51] Int. Cl.[4] ..... B21J 15/24

[52] U.S. Cl. ..... 72/430; 72/707; 83/575; 100/917

[58] Field of Search ..... 72/430, 707; 83/575; 100/917

[56] References Cited

U.S. PATENT DOCUMENTS

| | | | |
|---|---|---|---|
| 1,491,657 | 4/1924 | Barnett . | |
| 1,582,217 | 4/1926 | Henry . | |
| 1,684,296 | 9/1928 | Brodsky . | |
| 1,895,401 | 1/1933 | Simonsen . | |
| 2,155,578 | 4/1939 | Anderson | 164/49 |
| 2,509,956 | 5/1950 | Benoit | 164/94 |
| 2,539,083 | 1/1951 | Foley | 164/86 |
| 2,825,406 | 3/1958 | Hagopian | 164/113 |
| 2,951,437 | 9/1960 | Diener | 100/256 |
| 3,029,676 | 4/1962 | Rabinow | 83/575 |
| 3,486,400 | 12/1969 | Westmijze | 77/32.9 |
| 3,644,932 | 2/1972 | Wallace et al. | 346/77 |
| 3,709,083 | 1/1973 | Doherty | 83/575 |
| 3,730,039 | 5/1973 | Fedrigo | 83/170 |
| 4,022,090 | 5/1977 | Doherty | 83/162 |
| 4,126,069 | 11/1978 | Shimonaka | 83/575 |

FOREIGN PATENT DOCUMENTS

| | | | |
|---|---|---|---|
| 223120 | 12/1984 | Japan | 72/430 |
| 2033277 | 5/1980 | United Kingdom | 72/430 |
| 432953 | 6/1974 | U.S.S.R. | 72/430 |
| 650705 | 3/1979 | U.S.S.R. | 72/430 |
| 821018 | 4/1981 | U.S.S.R. | 100/917 |
| 880597 | 11/1981 | U.S.S.R. | 72/430 |
| 1119765 | 10/1984 | U.S.S.R. | 72/430 |

*Primary Examiner*—Robert L. Spruill
*Assistant Examiner*—David B. Jones
*Attorney, Agent, or Firm*—Townsend and Townsend

[57] ABSTRACT

Apparatus for mounting a pair of die members so that one die member can move toward and away from the other die member. The apparatus includes a pair of spaced die shoes for mounting respective die members and an electromagnetic unit for moving one of the die shoes toward the other die shoe. The electromagnetic unit includes a coil mounted on one of the die shoes and an armature mounted on the other die shoe, the electromagnet and the armature being between the die shoes. The armature is aligned with and partially extends into a recess in the central portion of the coil so that, when current flows through the coil, the armature is attracted to the coil and moves the other die shoe toward the one die shoe. A bias structure biases the other die shoe away from the one die shoe. Such bias structure can take the form of an air cylinder or a spring.

10 Claims, 3 Drawing Figures

DIE APPARATUS HAVING AN ELECTROMAGNETIC DRIVE

This invention relates to improvements in die machines, such as punch press machines and the like, and, more particularly, to an improved power-actuated machine having a more efficiently positioned power means associated therewith.

BACKGROUND OF THE INVENTION

Punch press machines and die forming machines have used electromagnetic power devices for moving one die toward another die so that a workpiece between the dies can be formed, punched or otherwise changed in shape or configuration. Disclosures relating to this concept are set forth in the following U.S. patents:

| | |
|---|---|
| 1,491,657 | 3,486,400 |
| 1,582,217 | 3,644,932 |
| 1,895,401 | 3,709,083 |
| 2,825,406 | 3,730,039 |
| 2,951,437 | |

For the most part, the power sources of these disclosures are mounted either above the die members or below the die members. In either position, they are often inefficiently placed and require additional structure for mounting them, especially where such power sources are heavy and of a relatively large size. Because of these drawbacks, a need has existed for an improved die apparatus with a power source which is more properly located to give greater efficiency of operation of the apparatus. The present invention satisfies this need.

SUMMARY OF THE INVENTION

The present invention is directed to improved die apparatus comprised of a pair of die shoes for mounting a pair of die members for movement into and out of cooperative relationship to each other, wherein the apparatus includes an improved power source between the die shoes, rather than above or below the die shoes as shown in the prior art. Thus, the apparatus of the present invention is more compact and is more versatile than prior art machines yet the invention has sufficient power to drive the die members into cooperative relationship with each other.

To achieve the foregoing, the die shoes of the present invention are shiftably coupled together for movement relative to each other, and the die shoes have surfaces which face each other. The power source of the invention includes a coil and an armature mounted on respective surfaces of the die shoes. In a preferred embodiment, the coil is mounted on the lower die shoe and has a central recess. The armature is mounted on the upper die shoe and extends downwardly therefrom and is partially received within the recess of the coil. Thus, when an electrical current flows through the coil, a magnetic force is created on the armature which attracts it to the coil and moves the upper die shoe downwardly relative to the lower die shoe. In the alternative, the coil could be on the upper die shoe and the armature mounted on the lower die shoe so as to achieve relative movement of the die shoes when an electrical current flows through the coil.

Means is provided on the die shoes for biasing the die shoes away from each other. Such means can take the form of a coil spring mounted in any suitable manner to bias the die shoes apart. The bias means can also take the form of an air cylinder or a combination of a spring and an air cylinder.

The primary object of the present invention is to provide an improved die apparatus having a pair of die shoes and an electromagnetic power source between the die shoes, whereby the apparatus is simple and rugged in construction, is comprised of a minimum number of parts and can be produced at minimum cost without sacrificing the efficiency of operation thereof.

Other objects of this invention will become apparent as the following specification progresses, reference being had to the accompanying drawings for an illustration of the invention.

Figure 1:
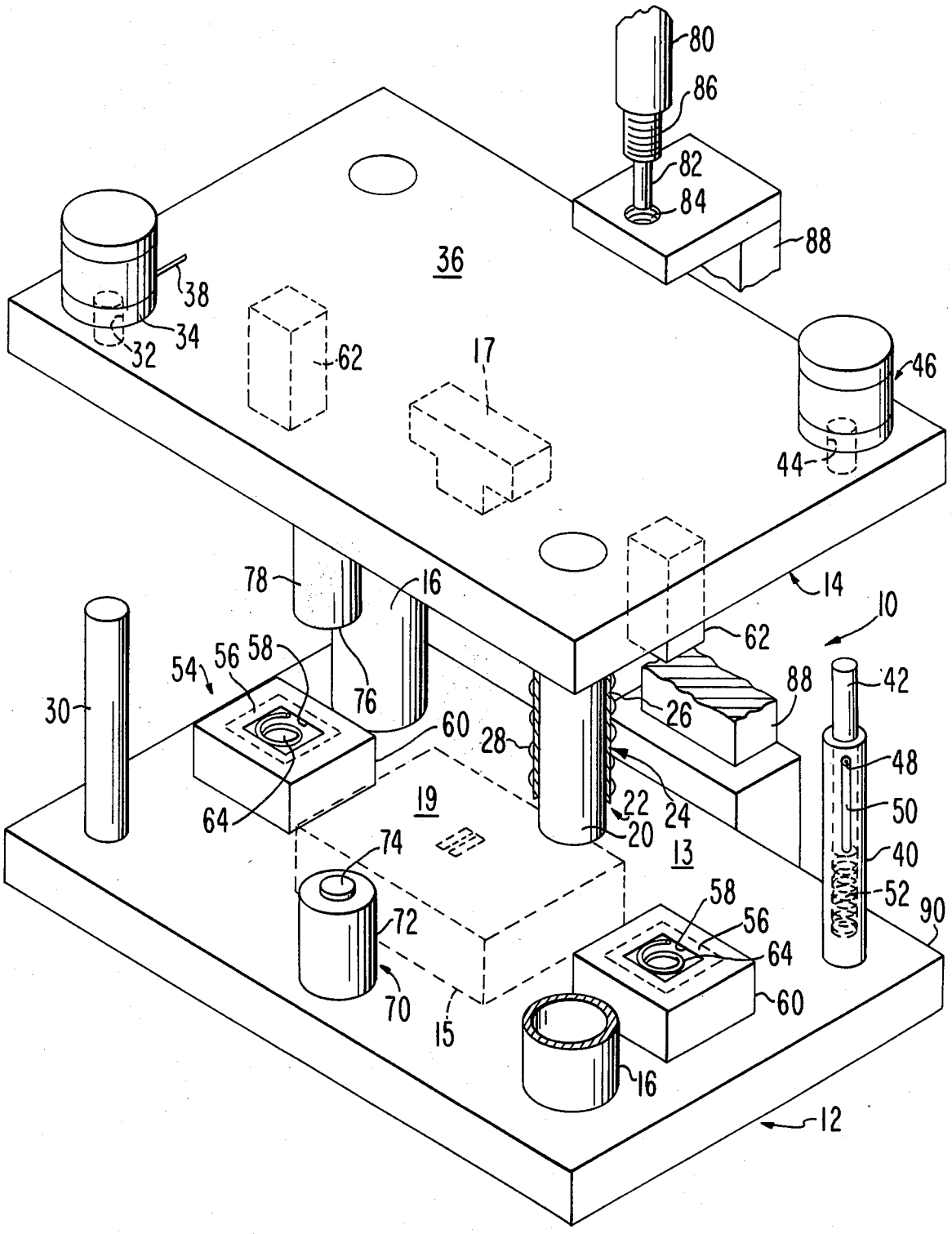
FIG. 1 is a perspective view of the improved die apparatus of the present invention.

The improved die apparatus of the present invention is broadly denoted by the numeral 10 and includes a lower die shoe 12 and an upper die shoe 14, the lower and upper die shoes being in the form of flat plates and being movable relative to each other so that one of the die shoes can move toward and away from the other die shoe. Typically, lower die shoe 12 is on a support surface, such as a table top. Upper die shoe 14 is then mounted on the lower die shoe 12 as hereinafter described so that the upper die shoe can move upwardly and downwardly with reference to the upper surface 13 of lower die shoe 12.

For purposes of illustration, the lower die shoe has a die block 15 mounted thereon, and the upper die shoe has a die or punch 17 mounted thereon. Die 17 is typically adapted to engage a workpiece mounted on the uppper surface 19 of die block 15. Other configurations of die block 15 and die 17 can be used, if desired or necessary to perform a specific task.

Upper die shoe 14 may be shiftably mounted on lower die shoe 12 in any suitable manner. For purposes of illustration, a pair of tubular bushings 16 are mounted at suitable locations on the upper surface 13 of lower die shoe 12 and extend upwardly therefrom. Each bushing 16 has an open top 18, only one of which is shown in FIG. 1, and each bushing is adapted to receive a post 20 for up and down movement of the post 20 relative to the respective bushing 16.

A tubular bearing 22 of conventional construction is carried on each post 20, respectively, for movement therewith. The bearing 22 includes a tubular member 24 having spaced holes in the side wall 26 thereof and a plurality of ball bearings 28 extending partially out of the holes in the side wall 26 for rolling engagement with the inner surface of the corresponding bushing 16. Thus, bearings 22 minimize the frictional effects between bushings 16 and respective posts 20.

Means is provided for biasing the upper die shoe 14 upwardly and away from lower die shoe 12. Such means can take any suitable form. One form of such means includes a pin 30 rigid to and extending upwardly from the upper surface 13 of lower die shoe 12 at each of a pair of corners, respectively, of lower die shoe 12.

Such corners typically are diagonal corners, but the pins 30 could be at other locations, if desired. The upper end of pin 30 is received within a bore 32 in an air cylinder 34 mounted in some suitable manner on the upper surface 36 of die shoe 14. Air cylinder 34 is provided with a supply of air from an air source (not shown) coupled with an air line 38 which leads away from air cylinder 34. The upper end of rod 30 is normally in bore 32 of air cylinder 34 so that when the die shoe 14 moves downwardly under a force as hereinafter described, air in the cylinder is compressed as a greater volume of rod 30 enters bore 32. This causes a restoring force to be exerted upwardly on cylinder 34, tending to return upper die shoe 14 to its upper, equilibrium position.

Other bias means could be provided, if desired. For instance, a pair of tubular, upright members 40 (only one of which is shown in FIG. 1) could be used at a pair of spaced locations on lower die shoe 12. Each tubular member 40 has a rod 42 extending partially thereinto, and rod 42 extends upwardly and is adapted to be received within a bore 44 formed in the lower surface of upper die shoe 14. Bore 44 is adjacent to an air cylinder 46 as shown in FIG. 1 to illustrate the way in which the air cylinder 46 would be used in conjunction with air cylinder 34 if member 40 and rod 42 were to be replaced by a rod identical to rod 30. However, if member 40 is used, it shiftably receives rod 42, the latter having a pin 48 extending radially from the outer surface thereof and into a slot 50 in member 40. A coil spring 52 is in member 40 below rod 42 to bias rod 42 upwardly and thereby apply an upward bias force to upper die shoe 14. In lieu of a spring 52, the interior space of the lower part of member 40 could form an air cylinder so that the air would be under compression in such space to apply an upward bias force to rod 42 at all times. When the rod 42 moves downwardly upon downward movement of upper die shoe 14, the air in the space at the lower end of member 40 will be further compressed to increase the restoring force exerted on rod 42, tending to return the upper die shoe 14 to its upper equilibrium position upon removal of a downward force exerted on the upper die shoe in a manner hereinafter described.

To apply a downward force, an electromagnetic unit 54 is provided, said unit 42 being at least at one location between lower and upper die shoes 12 and 14. For purposes of illustration, a pair of units 54 is shown in FIG. 1, each unit 54 including a coil 56 received within an open top recess 58 of a rigid block 60 secured in some suitable manner to upper surface 13 of lower die shoe 12. Each unit 54 is on a respective side of die block 15 as shown in FIG. 1, and each coil 56 has a central, open recess 58 for receiving the lower end of an armature 62 rigidly secured at its upper end to the lower surface of upper die shoe 14. Each coil is typically held in its block 60 by an epoxy material but other means may be provided for this purpose.

Armatures 62 generally have the same configuration as recesses 58 of the corresponding coils 56. For purposes of illustration, each recess 58 is square in configuration; thus, the corresponding armature 60 is also square in cross-sectional configuration. The coils 56 are coupled to control means (not shown) which, when operating so as to cause a current flow through the coils 56, will cause armatures 62 to be magnetically attracted into recesses 58 of coils 56, thereby causing downward movement of the upper die shoe 14 relative to lower die shoe 12. When this occurs, die 17 moves downwardly and into a die punching or forming relationship to a workpiece mounted on the upper surface 19 of die block 15. The forces exerted on armatures 62 are generally equal and in the same direction so that the armatures are simultaneously pulled downwardly when current flows through coils 56. When the current flow through the coils is stopped, the magnetic forces exerted on armatures 62 are removed and the bias forces exerted in the manner described above on upper die shoe 14 cause the upper die shoe to rise and move back into its normal or equilibrium position with die 17 in a position spaced above the upper surface 19 of die block 15.

To assist in biasing die shoe 14 upwardly, coil springs 64 may be provided in respective recesses 58 of coils 56. Such coil springs are compressed by armatures 62 as the armatures are pulled downwardly by virtue of the magnetic attractive forces exerted thereon when current flows through coils 56.

Figure 2:
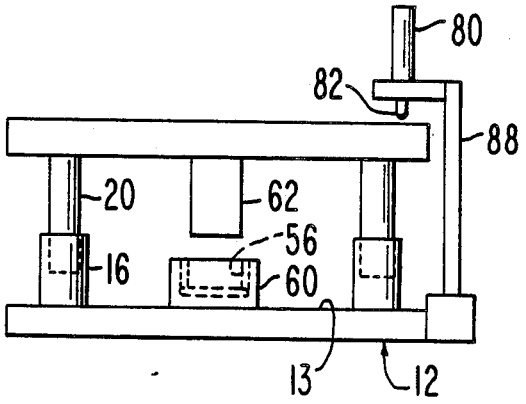
FIG. 2 is an end elevational view of the die apparatus of FIG. 1.

A die stop 70 is generally provided to limit the downward movement of upper die shoe 14 relative to lower die shoe 12. To this end, a tubular die stop element 72 is mounted in some suitable manner at a fixed location on upper surface 13 of lower die shoe 12. The element 72 is typically tubular at least through a short distance extending downwardly from the open top thereof, and a resilient cushion 74 is provided in element 72 and projects slightly upwardly therefrom. Cushion 74 may be of any suitable material, such as urethane. The upper surface of the cushion 74 is flat and is adapted to engage the flat under surface 76 of a second stop element 78 secured to and extending downwardly from the lower surface of upper die shoe 14 in alignment with element 72. Thus, upon downward displacement of upper die shoe 14, the lower flat surface 76 of element 78 impacts against cushion 74 and stops the downward movement of upper die shoe 14 relative to lower die shoe 12. Because the cushion is resilient, it deadens the sound of the lower face 76 of element 78 impacting thereon. Thus, there is no metal on metal contact which would emit a harsh sound. While only a single stop has been shown, one or more stops can be used at various locations on upper surface 13. Moreover, element 78 could be eliminated and member 72 could be made so that it is longer in length than that shown in FIG. 2, whereupon the lower surface of upper die shoe 14 will engage cushion 74 to limit the downward travel of upper die shoe 14.

A shock absorber 80 can be provided to increase the rate at which upper die shoe 14 is damped as it returns to its upper, equilibrium position. To this end, shock absorber 80 is conventional in construction and includes a piston rod 82 which extends out of a cylinder 81 and downwardly from a support plate 83. Rod 82 has a lower end for engaging the upper surface 36 of upper die shoe 14 when the die shoe moves upwardly after the magnetic forces due to current flow through coils 56 are removed. The shock absorber 80 has a threaded neck 86 which is threadably mounted within a threaded hole 84 of plate 83, plate 83 being secured to the upper end of a leg 88 which is secured at its lower end to the rear side face 90 of lower die shoe 12. Thus, the upper die shoe will damp out at a high rate after engaging the lower end of piston 82, thereby making the upper die plate 14 ready for the next stroke immediately. Air cylinder 34 may serve as a shock absorber on the downstroke, if desired.

Figure 3:
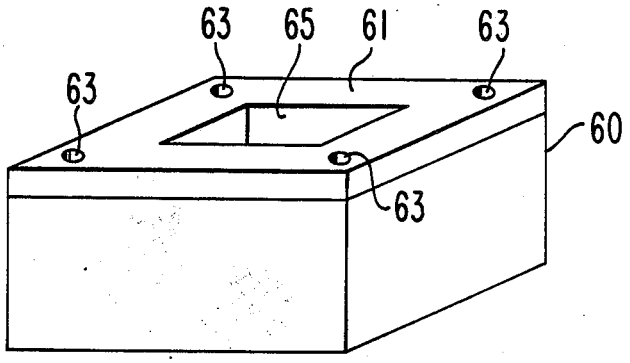
FIG. 3 is a perspective view of a coil housing for the apparatus of the present invention, the housing having an optional metal cover plate to concentrate the magnetic flux of the adjacent coil.

Each rigid block 60 can have, as an option, a metal cover plate 61 (FIG. 3) releasably attached thereto, such as by screws 63. The cover plate 61 has a central opening 65 for receiving the corresponding armature.

The cover plate serves to concentrate the magnetic flux from the adjacent coil so that the flux does not interfere with other, adjacent parts of apparatus 10.

I claim:

1. Die apparatus comprising:

a pair of vertically spaced die shoes for supporting a pair of die members, the upper die shoe having a lower surface and the lower die shoe having an upper surface;

means mounting one of the die shoes on the other die shoe for movement toward and away from the other die shoe;

actuatable solenoid means between the die shoes for moving said one die shoe toward the other die shoe, said solenoid means including an open end coil secured to and extending outwardly from a first of said surfaces and an armature secured to the second of said surfaces and extending outwardly therefrom to a location in proximity to said coil, the coil having a recess for receiving the armature, whereby actuation of said solenoid means will cause the armature to be attracted into the coil and will cause movement of the die shoes relative to and toward each other; and means coupled with the die shoes for biasing the one die shoe away from the other die shoe.

2. Apparatus as set forth in claim 1, wherein said solenoid means includes a coil block having a central opening therein, said coil in the opening of the coil block.

3. Apparatus as set forth in claim 2, wherein is included spring means within the recess of the coil for biasing the armature out of the recess when the armature is in the recess.

4. Apparatus as set forth in claim 1, wherein is included a stop between the die shoes for limiting the movement of said one die shoe toward the other die shoe.

5. Apparatus as set forth in claim 1, wherein said one die shoe is above the other die shoe.

6. Apparatus as set forth in claim 5, wherein said armature extends downwardly from said one die shoe, said coil being secured to said other die shoe and having said recess to for at least partially receiving the armature.

7. Apparatus as set forth in claim 5, wherein said coil is secured to said one die shoe, said armature being secured to the other die shoe, said coil having said recess at least partially receiving the armature.

8. Apparatus as set forth in claim 1, wherein is included a first die member on said one die shoe and a second die member on the other die shoe, said die members being movable into operative positions adjacent to each other when the one die shoe moves toward the other die shoe.

9. Apparatus as set forth in claim 8, wherein said electromagnetic means includes a coil and armature on each side, respectively, of the zone occupied by the die members, each coil having a recess for at least partially receiving the corresponding armature.

10. Apparatus as set forth in claim 9, wherein is included a block having an open top recess, said coil being in the recess of the block, there being a cover plate releasably mounted on the block to concentrate the magnetic flux of the coil, said cover plate having an armature-receiving, substantially square central opening aligned with the open top of said recess.

* * * * *